US005096374A

United States Patent [19]

Sakai et al.

[11] Patent Number: 5,096,374

[45] Date of Patent: Mar. 17, 1992

[54] VANE CONTROLLER

[75] Inventors: Haruki Sakai; Hisashi Nishkawa, both of Ibaraki, Japan

[73] Assignee: Hitachi, Ltd., Tokyo, Japan

[21] Appl. No.: 474,141

[22] Filed: Feb. 2, 1990

[30] Foreign Application Priority Data

Feb. 2, 1989 [JP] Japan ..... 1-22567

[51] Int. Cl.[5] ..... F01D 17/16

[52] U.S. Cl. ..... 415/150; 415/159; 384/206

[58] Field of Search ..... 415/148, 150, 151, 159, 415/160, 155; 384/206

[56] References Cited

U.S. PATENT DOCUMENTS

| | | | |
|---|---|---|---|
| 2,827,224 | 3/1958 | Madison et al. . | |
| 2,842,305 | 7/1958 | Eckenfels et al. | 415/160 |
| 3,535,006 | 10/1970 | Orkin et al. | 384/206 |
| 3,566,916 | 3/1971 | Root | 137/601 |
| 3,893,784 | 7/1975 | Zerlauth | 415/149.1 |
| 4,049,360 | 9/1977 | Snell | 415/149.1 |
| 4,373,859 | 2/1983 | Thebert | 415/159 |
| 4,430,043 | 2/1984 | Knight et al. | 415/159 |
| 4,718,780 | 1/1988 | Trudeau | 384/206 |
| 4,773,821 | 9/1988 | Gonthier et al. | 415/150 |

FOREIGN PATENT DOCUMENTS

| | | | |
|---|---|---|---|
| 2250559 | 10/1972 | Fed. Rep. of Germany . | |
| 2255853 | 5/1974 | Fed. Rep. of Germany . | |
| 2618727 | 11/1976 | Fed. Rep. of Germany . | |
| 44-21729 | of 1969 | Japan . | |
| 59-49759 | of 1982 | Japan . | |
| 0093967 | 6/1983 | Japan | 415/150 |
| 2142990 | 1/1985 | United Kingdom | 384/206 |

*Primary Examiner*—Edward K. Look
*Assistant Examiner*—Hoang Nguyen
*Attorney, Agent, or Firm*—Antonelli, Terry, Stout & Kraus

[57] ABSTRACT

A vane controller for a plurality of vanes disposed in a fluid conduit has vane shafts connected to the vanes and extending radially and spaced circumferentially around the conduit, and a control ring outside the conduit and movable circumferentially and connected to said vane shafts by levers to cause the vane shafts to rotate in unison to adjust the vane position. To reduce friction, the control ring is movable both circumferentially and axially and is preferably spaced from the conduit wall. A spherical bearing on the ring slidably receives a pin carried by each lever.

17 Claims, 5 Drawing Sheets

VANE CONTROLLER

BACKGROUND OF THE INVENTION

1. Field of the Invention

This invention relates to a vane controller for controlling a plurality of vanes disposed in a fluid conduit and more particularly, to a vane controller for driving a set of vanes which effect capacity control in a fluid machine such as a turbo-compressor having a vane wheel such as, for example an axial or radial flow vane wheel.

2. Description of the Prior Art

A conventional vane control apparatus is disclosed, for example, in Japanese Patent Publication JP-B-57-49759 includes, as shown in FIGS. . This apparatus will be explained with 9 to 11, a vane wheel 1 of a centrifugal compressor and a casing 2 for the flow control vanes and the vane controller attached to a suction bell mouth 2*a*. A plurality of vanes 3 are mounted upstream of the vane wheel 1, with one of vane 3 being a driving vane 3*a*. The outer end portions of these vanes 3, 3*a* are supported by vane shafts 4, 4*a* carried by ball bearings 5 disposed in the casing 2. A driving arm 6 is fixed to the driving vane shaft 4*a* and a connecting rod 7 has one end fitted to the driving arm 6 by a pin 8 and the other end fitted to an actuator 9. The driving vane shaft 4*a* is rotated by the operation of the actuator 9.

A driving control lever 10 is fitted at one end to the driving vane shaft 4*a* and the other end of this lever 10 is connected to a control ring 11, which is arranged to slidably rotate around the outer periphery of the casing 2 adjacent to the vane shafts 4, 4*a*, through a linkage 12 composed of two universal joints. Since each vane shaft 4 is connected to the control ring 11 through a follower control arm 14 with a similar linkage 13, all the vane shafts 4 are rotated in synchronism with the driving vane shaft 4*a* through the control ring 11 when the driving vane shaft 4*a* is rotated by the operation of the actuator 9. Thus, the degree of opening of the vanes is selected.

A problem with this conventional vane control mechanism is as follows resides in the fact that the control ring 11 moves round the surface of the casing 2 and frictional resistance is great so that the torque required of the actuator for driving all the vanes 3 is considerable. If this frictional torque can be reduced, the torque required is only the air torque acting on each vane 3, 3*a* and consequently, the torque necessary for moving the vanes can be reduced drastically. Large frictional resistance results in poor response of the vane opening and closing operation and is not suitable for the case where the vanes are repeatedly opened and closed. In addition, the linkage between the levers and the control ring is complicated.

Japanese Utility Model Publication JP-B-44-21729 discloses another vane control mechanism applied to rotating vanes in an axial compressor, in which a control ring in a fixed axial position moves the vane shafts through levers having spherical ends received in bearing sleeves which slide both radially and axially in apertures in the control ring. The ring is spaced from the compressor duct wall and slides at its inside face on the projecting ends of the vane shafts. A disadvantage of the vane control mechanism of the last-mentioned type resides in the fact that the rotating lever is difficult to machine thereby causing high production costs since spherical machining is necessary for the spherical bearing and the tip of the lever.

SUMMARY OF THE INVENTION

In order to solve the problems and disadvantages of the prior art described above, the present invention has the object of providing a vane controller which can reduce frictional resistance of the control ring and is simple in construction and can reduce the production cost.

In the present invention the control ring is movable both in a circumferential and axial direction.

In one form of the invention, the vane shafts are attached to first ends of levers, and second ends of the levers are connected to the control ring by connections constraining said ring and the second ends to circumferentially move together, while permitting relative movement of each second end and the ring in a direction having a component parallel to the respective vane shaft axis. The control ring is movable both circumferentially and axially and the second ends of the levers are constrained by the connections to move both circumferentially and axially with the ring.

Preferably, the second end of each lever and the ring are connected by a first element and a second element, the first element being one of a pin and a bearing receiving the pin and the second element being the other of the pin and the bearing, and with the first element being at a fixed location on the lever and the second element being at a fixed location on the bearing.

The bearing preferably has a spherical bearing member slidably and rotatably receiving the pin at a center thereof and a housing retaining the spherical bearing member.

The control ring is preferably spaced from the wall of the conduit and resilient means, such as for example springs, arranged between the levers and the control ring, to maintain the position of the ring.

In another apsect, the invention provides a combination for use in a vane controller for controlling the positions of a plurality of vanes disposed in a fluid conduit and rotatable about radial axes, with the combination comprising the control ring and a plurality of the levers.

In yet another aspect of the invention, the control ring is spaced from the wall of the conduit and is supported by support means acting upon an outer periphery thereof. The said support means are suitably arranged at at least three separate and spaced locations around the ring. Preferably there are not more than six separate and spaced locations, and each support means may comprise a roller contacting the outer periphery of the ring.

The invention also provides a turbo-compressor having an inlet conduit, vanes in the inlet conduit for control of inlet gas to the compressor, and a vane controller as described above for controlling the positions of the vanes.

The invention also provides a bearing comprising a sleeve providing a bore suitable for slidably and rotatably receiving a cylindrical element, with a spherical bearing element having a central aperture in which the sleeve is secured and a housing retaining the spherical bearing member while permitting rotation about two mutually perpendicular axes.

BRIEF DESCRIPTION OF THE DRAWINGS

Embodiments of the invention will now be described by wa of non-limitative example with reference to the attached drawings in which.

DESCRIPTION OF THE PREFERRED EMBODIMENTS

Figure 9:
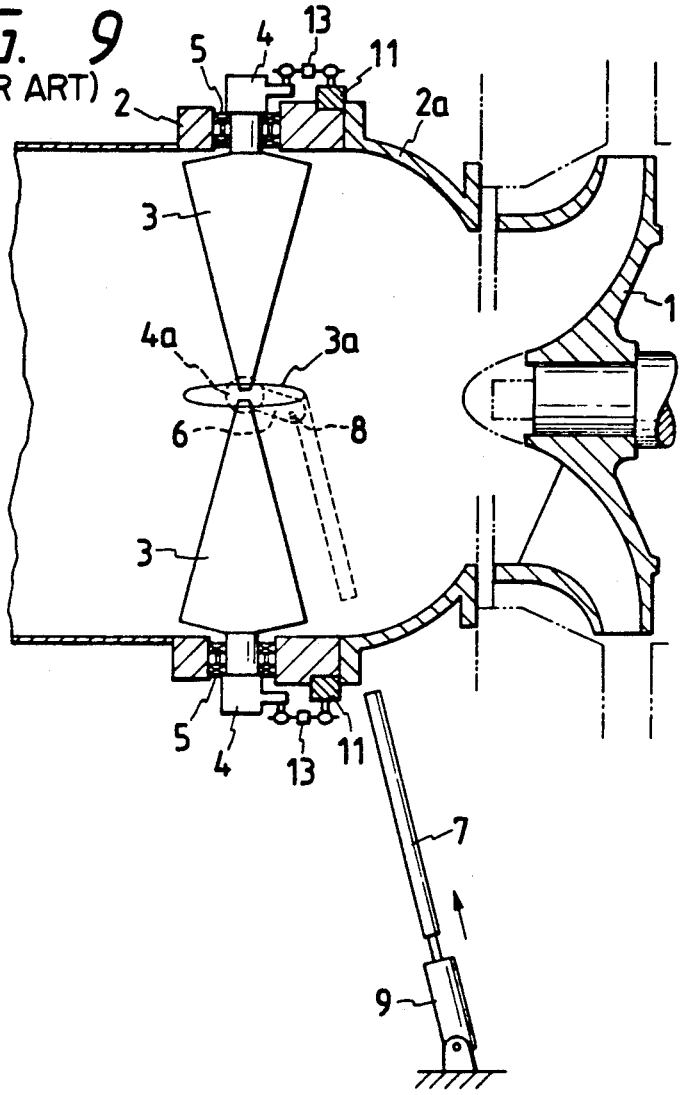
FIG. 9 (PRIOR ART)
FIG. 9 is a longitudinal sectional view showing the conventional vane controller already discussed.

In the drawings relating to the the invention, like reference numerals are used to identify the same or like components as in FIG. 9 showing the prior art apparatus, and will not be further described in detail.

Figure 2:
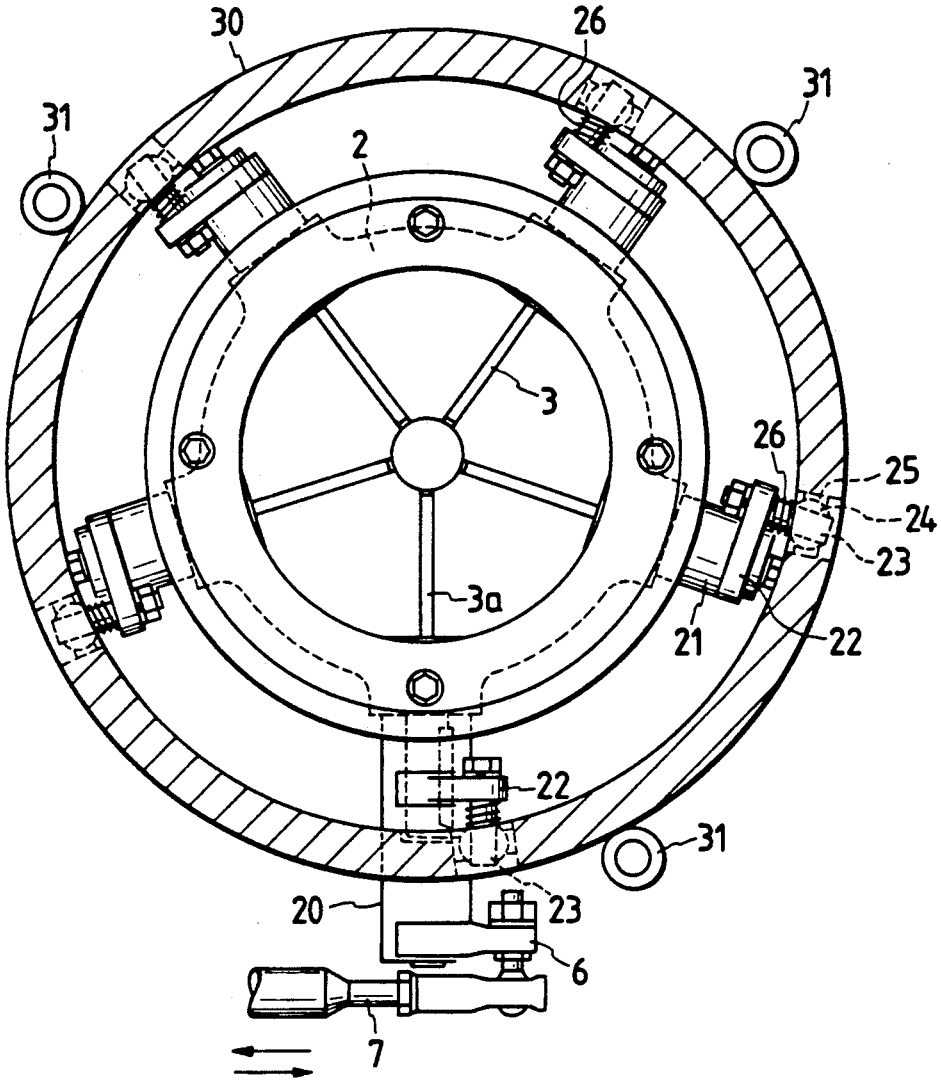
FIG. 2 is a front view onto the vanes of the vane controller, partly in section and in the direction of arrow A in FIG. 1.

Referring first to FIG. 2, there is shown a plurality, for example, five, flow control vanes 3, 3*a* in their fully open position inside the casing wall 2 of the inlet conduit of a turbo-compressor. The vanes are carried by radially extending vane shafts 20, 21, which are supported by bearings in the wall 2. The longer vane shaft 20 is the driving vane shaft carrying the driving vane 3*a* and driven by an actuator rod 7 through a lever 6, in a similar manner as described for FIG. 9. The control ring 30 of this embodiment is shown in section in FIG. 2.

Each vane shaft 20, 21 is connected to the ring 30 by a lever 22 which is rigidly attached to the vane shaft at one end and carries a rigidly mounted pin 23 at its other end. The pins 23 extend parallel to the axes of the vane shafts 20, 21 and are connected to the ring 30 by a bearing mechanism 24, 25 described in more detail below. FIG. 2 also shows helical springs 26 surrounding the pins 23 and providing an outward resilient force acting between the levers 22 and bearings 24, 25, to urge the ring 30 outwardly. This has a centering effect on the ring 30. The ring 30 is also supported by bearings 31, described in more detail below, which engage its outer periphery at three spaced apart and separate locations, as can be seen in FIG. 2. FIG. 2 also shows that the ring 30 is substantially spaced from the wall 2 of the conduit.

Figure 1:
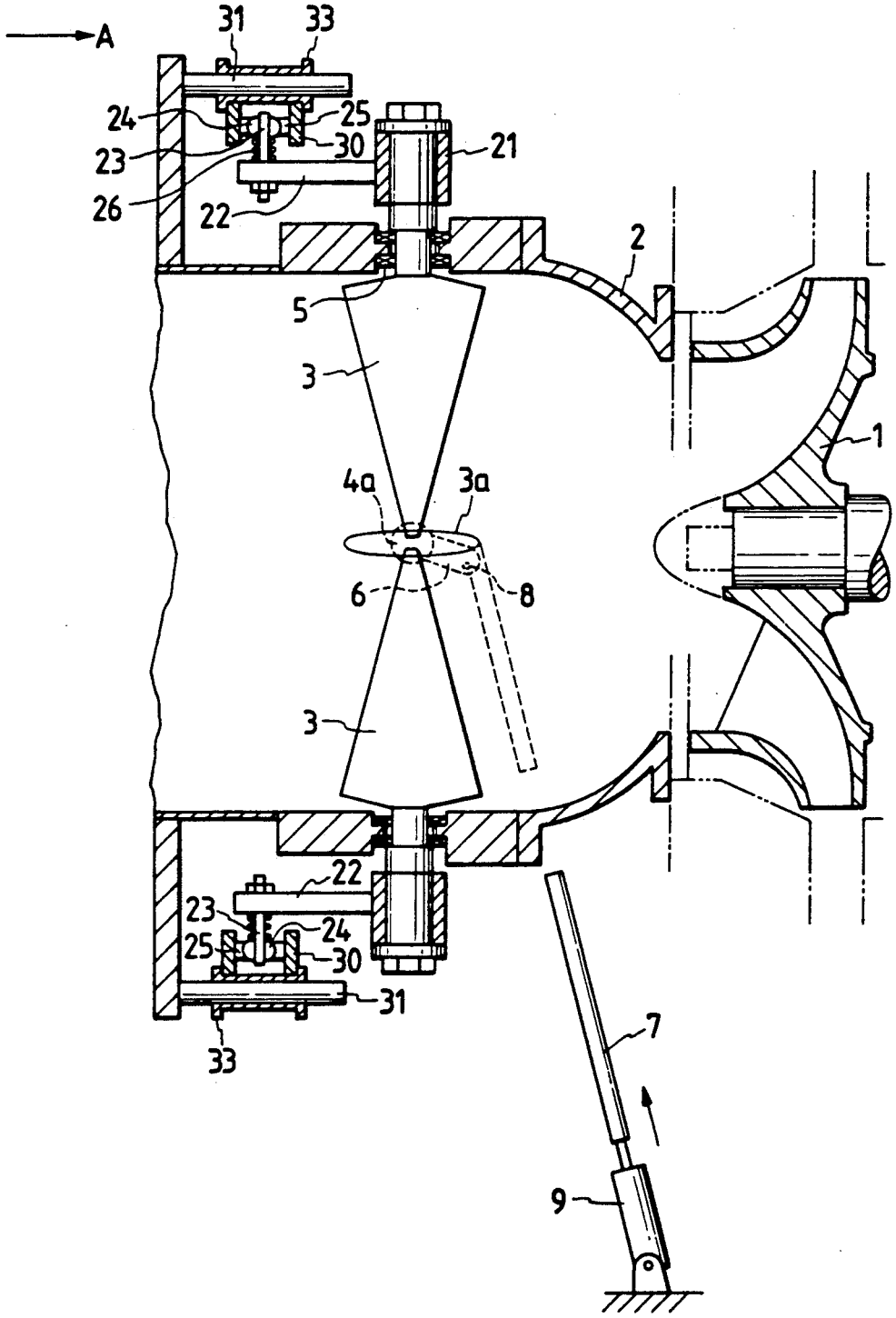
FIG. 1 is a sectional side view of part of a vane controller for a turbo-compressor in accordance with one embodiment of the present invention.

FIG. 1 shows the ball bearings 5 by which the vane shafts 20, 21 are located in the conduit wall 2 and shows the ring 30 supported at its radially outer side by the bearing 31. This bearing 31, together with the connection between the pins 23 and the ring 30, allow this control ring 30 to move both circumferentially and axially with respect to the axis of the conduit 2.

Figure 3:
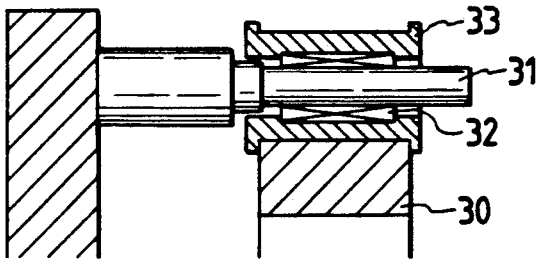
FIG. 3 is an enlarged partial sectional view on the line B in FIG. 2.

As shown in FIG. 3, a fixed rod 31 slidably carries a rolling bearing 32, which carries a roller 33 having a surface in rolling contact with the outer peripheral face of the ring 30 and flanges at its axial ends to retain the ring 30. The bearing 32 is slidable along the rigid rod 31, to permit the control ring 30 to move axially.

Figure 4:
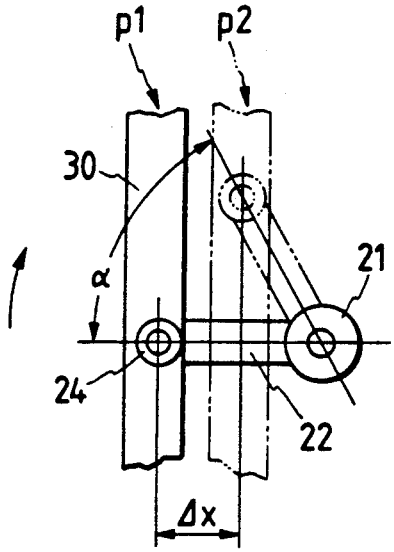
FIG. 4 is an explanatory view showing the movement of the control ring of FIG. 1 in the axial direction.
Figure 5:
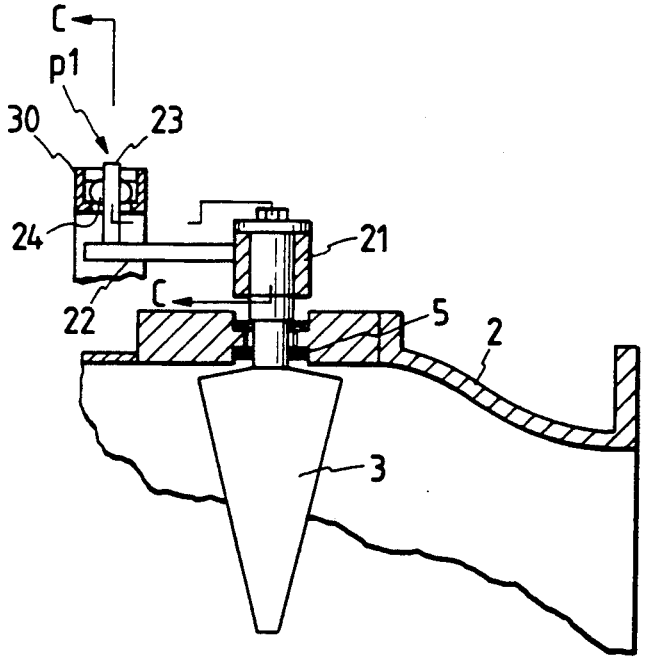
FIG. 5 is a part sectional side view similar to FIG. 1 showing the principal portions of the vane controller.
Figure 6:
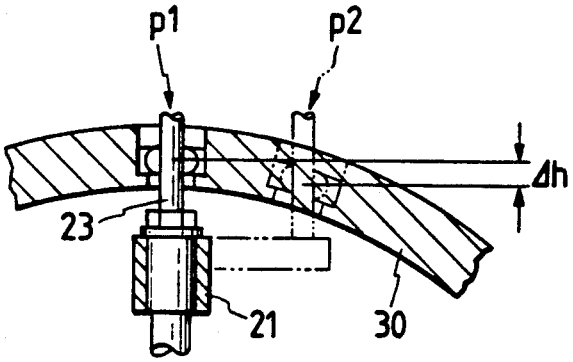
FIG. 6 is a sectional view on line C—C in FIG. 5.

FIG. 4 shows the principle of the axial and circumferential movement of the control ring 30 and the bearing 24 receiving the pin 23 of the lever 22 which rotates around the axis of the vane shaft 21. When the vane shaft 21 rotates by an angle of $\alpha$ degrees, the control ring 30 moves in the axial direction (to the right) by the distance $\Delta x$ from the original position (p1) to the second position (p2). The control ring 30 also moves circumferentially, and the bearing 24, 25 constrains the pin 23 to move both axially and circumferentially with the ring 30. Since the lever 22 moves in a plane, the pin 23 must move, relative to the ring 30, in the direction parallel to the axis of the vane shaft 21. This movement, which is permitted by the construction of the bearing 24, 25 is illustrated in FIG. 6, where the two positions of the pin 23 corresponding to the positions (pl) and (p2) are shown. It can be seen that the bearing 24, 25 and the pin 23 have moved relatively by a distance $\Delta h$. In effect the pin 25 slides through the bearing 24, 25, and the amount of such sliding is sufficient to allow the desired degree of control of the vanes.

Figure 7:
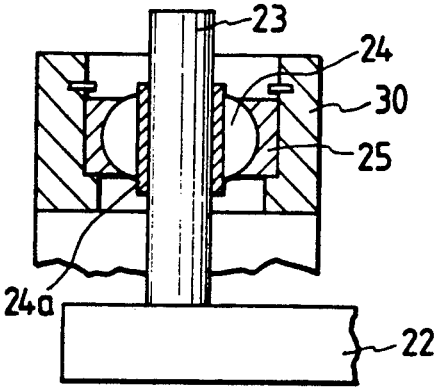
FIG. 7 is an enlarged view showing the bearing portion of FIG. 6.

The construction of the bearing 24, 25 is shown in detail in FIG. 7. The bearing includes a sleeve 24*a* forming a plain bearing slidably receiving the pin 23. Thus the pin 23 can move axially with respect to the sleeve 24*a* and can also rotate in the sleeve 24*a*. The sleeve 24*a* is fixedly mounted, by press fitting, in a central aperture in a spherical bearing member 24, which is itself spherically rotatable about two mutually perpendicular axes inside a housing 25 having a surface corresponding to the spherical outer surface of the bearing member 24, with the housing 25 be fixed in the ring 30.

The pin 23 is as mentioned fixed in position on the lever 22. The bearing arrangement shown in FIG. 7 is itself fixed in its location in the ring 30, but permits the pin 23 to tilt relative to the ring 30 in the plane of the ring 30, by movement of the bearing member 24 in the housing 25. This tilting movement is required in order that the pin 23 shall remain parallel to the axis of the vane shaft 21, as the ring 30 rotates circumferentially around the conduit. Additionally the pin 23 is able to move, relative to the ring 30, in the direction of the axis of the vane shaft 21, by sliding along the sleeve 24a.

Although the spherical bearing member 24 allows tilting of the sleeve 24*a* about two mutually perpendicular axes, it is in fact only necessary that the pin 23 can tilt relative to the ring 30 in the plane of the ring 30.

Both the plain bearing sleeve 24*a* and the spherical bearing 24 in its housing 25 are standard commercially available items, which are assembled as shown in FIG. 7 to provide the special bearing used in the invention.

Figure 10:
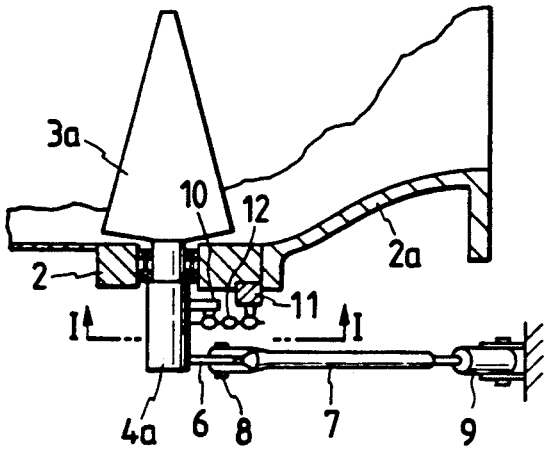
FIG. 10 (PRIOR ART)
FIG. 10 is a sectional side view showing portions at the driving vane of the controller shown in FIG. 9.
Figure 11:
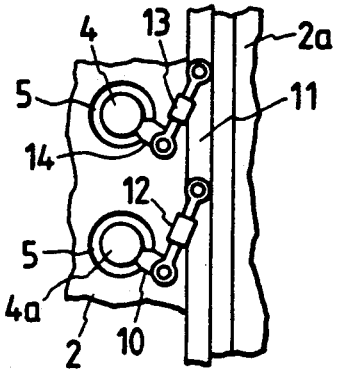
FIG. 11 (PRIOR ART)
FIG. 11 is a sectional view taken along line I—I of FIG. 10.

All the levers 22, pins 23 and bearing 24, 25 are identical, around the ring 30. An actuator 9 for the vane controller of FIGS. 1 to 7 is of a conventional type and corresponds to the actuator 9 of FIG. 10. Operation of the actuator 9 causes the rotation of the driving vane shaft 20 which in turn circumferentially drives the ring 30. The ring 30 is then constrained to move axially as well as circumferentially by the pins 23, and in turn rotates all of the vane shafts 21 to adjust all of the vanes in unison.

Although the control ring 30 as illustrated as being supported by the guide member 31 which incorporates a rolling bearing, alternatively a plain bearing may be used, which permits the axial movement of the control ring 30.

It will be appreciated that the mechanism of the invention described above has particularly low friction characteristics. Frictional resistance is provided only by the rolling bearings 33 and the movement of the pins 23 in the bearings 24, 25, apart from the resistance of the bearings 5 and the torque applied by the flowing air from the vanes 3, therefore, the total friction is small. The mechanism is also simple to produce and is economically producible, and is subject to little wear during operation, so as to enable an accurate control of the vanes.

Figure 8:
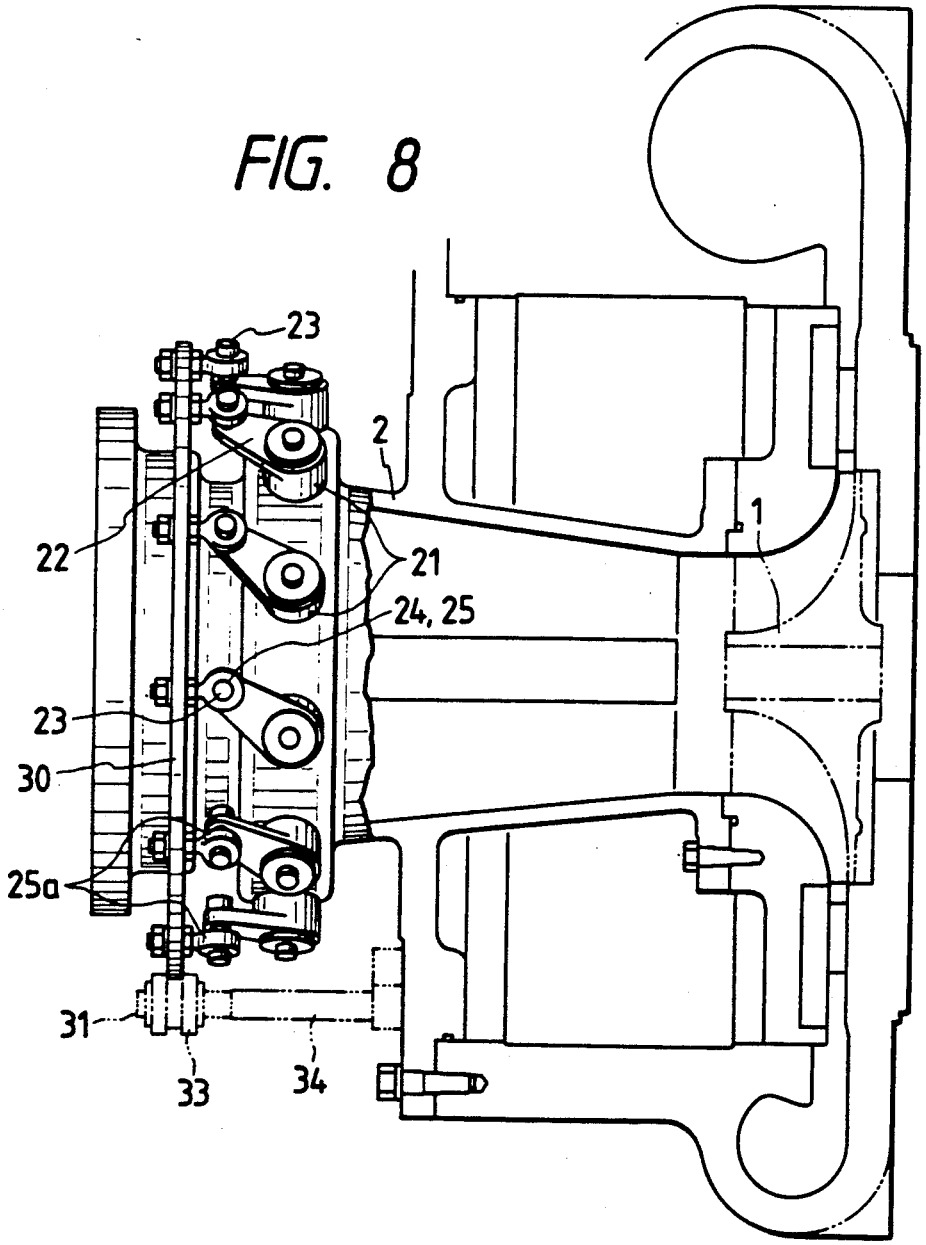
FIG. 8 is a side view, partly cut-away, of a second vane controller embodying the present invention applied to the inlet control vanes of a turbo-compressor;.

In the embodiment of FIG. 8, a radial turbine compressor wheel 1 includes an inlet conduit 2 thereto, with control vanes being mounted in the conduit 2 and being carried by vane shafts 21 projecting through the wall 2. Through levers 22, and pins 23 and bearings 24, 25 shown, for example, FIGS. 1 to 7, the vane shafts 21 are controlled in unison by the control ring 30 which in FIG. 8 is a circumferentially and axially movable annular plate, 30. The embodiment of FIG. 3 differs from that of FIGS. 1 to 7 in that the bearings 24, 25 are not mounted in the annular plate but on short rods projecting axially from the plate and rigidly secured by nuts to the plate 30 in the correct positions to receive the pins 23. Thus, as in the previous embodiment FIGS. 1-7, the bearings 24, 25 are fixed in their location relative to the control ring 30. FIG. 8 also shows one of the three rollers 33 engaging the outer periphery of the control ring 30 and rotatably and slidably mounted on the fixed rod 31 which is carried on the frame of the compressor by a rod 34.

It will be appreciated that the mechanism of both of the above-described embodiments have particularly low friction characteristics. Frictional resistance is provided only by the rolling bearings 33 and the movement of the pins 23 in the bearings 24, 25, apart from the resistance of the bearings 5 and the torque applied by the flowing air on the vanes 3 such that the total friction is small. The mechanism of the embodiment of FIG. 8 is also simple to produce and therefore economic in production. It undergoes little wear during operation, and thus provides accurate control of the vanes.

The number of control vanes is typically eleven in a turbo-compressor, but any suitable number may be applied in other devices, to which the invention is widely applicable.

Although in the above-described illustrated embodiments the pin 23 is shown mounted on the lever 22 and the bearing on the control ring 30, these positions may be reversed.

The minimum number of support bearings on the outer periphery of the control ring 30 is three in order to achieve concentric circumferential movement. More support bearings may be used, but for simplicity of construction and adjustment a preferred maximum, in practice, is six.

What we claim is:

1. A vane controller for a plurality of vanes disposed in a fluid conduit having a bounding wall and an outer surface of said wall, said vane controller having vane shafts connected to the vanes and extending radially and spaced circumferentially around the conduit, levers having first ends connected to said vane shafts and second ends, a control ring outside the conduit and movable both circumferentially and axially and connected to said second ends of said levers whereby movement of said ring moves said levers in unison to rotate the vane shafts and thereby adjust the vane positions, said control ring having an outer periphery, wherein said control ring is spaced from the said outer surface of said wall of the conduit and is provided with support means acting upon its outer periphery.

2. A vane controller according to claim 1, wherein said support means are arranged at at least three separate and spaced locations around the ring.

3. A vane controller according to claim 2, wherein there are not more than six of said separate and spaced locations.

4. A vane controller according to claim 2, wherein at each of said locations said support means comprises a roller contacting the outer periphery of the control ring.

5. A vane controller according to claim 1, wherein said second end of each lever and said control ring are connected by a first element and a second element, said first element is one of a pin and a bearing receiving said pin and said second element is the other of said pin and said bearing, and said first element is at a fixed location on said lever and said second element is at a fixed location on said bearing, and wherein said bearing has a sleeve providing a bore slidably and rotatably receiving said pin, a spherical member carrying said sleeve at a center thereof and a housing retaining said spherical bearing member.

6. A vane controller according to claim 5, wherein said control ring is spaced from said bounding wall of said fluid conduit.

7. A vane controller according to claim 6, including resilient means arranged between said second ends of said levers and said control ring.

8. A vane controller according to claim 7, having means for maintaining the radial position of said control ring.

9. A vane controller according to claim 1, wherein said second end of each of said levers and said control ring are connected by a first element and a second element, said first element is one of a pin and a bearing receiving said pin and said second element is the other of said pin and said bearing, and said first element is at a fixed location on said lever and said second element is at a fixed location on said bearing, and wherein said bearing comprises a sleeve providing a bore suitable for slidably and rotatably receiving a cylindrical element, a spherical bearing element having a central aperture in which said sleeve is secured and a housing retaining said spherical bearing member while permitting its rotation about two mutually perpendicular axes.

10. A bearing according to claim 9, wherein said sleeve is press-fitted in said aperture of said spherical bearing member.

11. A turbo-compressor having an inlet conduit, vanes in said conduit for control of inlet gas to the compressor, and a vane controller according to claim 2 for controlling the positions of said vanes.

12. A turbo-compressor having an inlet conduit, vanes in said conduit for control of inlet gas to the compressor, and a vane controller according to claim 5 for controlling the positions of said vanes.

13. A turbo-compressor having an inlet conduit, vanes in said conduit for control of inlet gas to the compressor, and a vane controller according to claim 1 for controlling the positions of said vanes.

14. A vane controller according to claim 1, wherein said support means includes a plurality of circumferentially spaced fixed rods each carrying a bearing means in contact with an outer peripheral surface of said control ring, and wherein each of said bearing means is slidable along the respective fixed rod so as to permit axial movement of the control ring.

15. A vane controller according to claim 14, wherein each of said bearing means includes a roller bearing.

16. A vane controller according to claim 4, wherein each of said bearing means includes a plane bearing.

17. A vane controller according to claim 5, wherein said control ring is fashioned as an annular plate, and wherein said bearing means are respectively mounted on short rods projecting from said annular plate.

* * * * *